United States Patent [19]

Berger

[11] 4,291,907

[45] Sep. 29, 1981

[54] DROP LATCH

[76] Inventor: Dale F. Berger, 14235 Julie Dr., Humble, Tex. 77338

[21] Appl. No.: 26,287

[22] Filed: Apr. 2, 1979

[51] Int. Cl.[3] ..... E05C 1/16

[52] U.S. Cl. ..... 292/188

[58] Field of Search ..... 292/158, 188, 161, 184, 292/186, 140

[56] References Cited

U.S. PATENT DOCUMENTS

| | | | |
|---|---|---|---|
| 197,112 | 11/1877 | Eaton . | |
| 481,597 | 8/1892 | Sorensen . | |
| 718,101 | 1/1903 | Decker . | |
| 742,876 | 11/1903 | Keverline | 70/140 X |
| 1,438,547 | 12/1922 | O'Connor | 292/161 |
| 1,503,209 | 7/1924 | Rees . | |
| 2,641,494 | 6/1953 | Burris . | |
| 3,087,750 | 4/1963 | Kelly | 292/161 |
| 3,722,236 | 3/1973 | Zelenko | 292/161 X |

*Primary Examiner*—Richard E. Moore

*Attorney, Agent, or Firm*—Richards, Harris & Medlock

[57] ABSTRACT

A drop latch (10) is described which has a bolt (24) that operates vertically within a housing (20). A plurality of arms (34–38) extend nomal from the bolt (24), each arm (34–38) having connected thereto a downward facing striker (40–44) having a tapered face (**40*a*–44*a*). The housing (20) has a plurality of slots (58–62) therein aligned with the strikers (40–44). A plurality of latch loops (74–78) are mounted on a latch plate (72) and spaced to enter the housing slots (58–62) and contact the strikers (40–44), which are forced upward and over the latch loops (74–78) and drop downward into the interior thereof. The bolt (24) is raised by a lever (18) to disengage the strikers (40–44) from the latch loops (74–78) so that the drop latch (10) can open from the latch plate (72**).

7 Claims, 4 Drawing Figures

DROP LATCH

FIELD OF THE INVENTION

The present invention relates to latch mechanisms and more particularly to a gate latch mechanism having a gravity positioned bolt.

BACKGROUND OF THE INVENTION

Heretofore a great number of gate latches have been developed for securing doors or gates in the closed position while permitting them to be easily opened. A gate structure now coming into widespread use is termed an ornamental gate and is generally utilized as a part of an installation of "burglar bars." A latch mechanism for such a gate must be strong, easily operated, and include a key-lock cylinder. It is further important that the latching and locking mechanism be enclosed within a strong housing to prevent removal or damage of the key-lock or other components of the latch.

A number of gate latches are shown in U.S. Pat. No. 197,112 to Eaton, U.S. Pat. No. 718,101 to Decker and U.S. Pat. No. 1,503,209 to Rees. These latches, however, do not include the features necessary for a burglar bar type latch.

DISCLOSURE OF THE INVENTION

A drop latch assembly includes a bolt which is located within a housing and guided along a path by pins mounted on an interior wall of the housing. A lever extends through a passage in the housing to engage the bolt and position it selectively along the path. Joined normal to the bolt are a plurality of arms each having a striker mounted normal thereto. The housing has a slot therein corresponding to each striker where the slot is aligned with the striker when the bolt is in its lowermost position. A lock cylinder operated by a key is located in the housing with the key driving a screw which jams the bolt in the lower position when the screw is advanced to a lock position by the key. The bolt is freely slidable along the path when the screw is set to other than the lock position. A latch plate is mounted on a doorway and has a plurality of latch loops one corresponding to each slot in the housing. Each latch loop is adapted to enter a housing slot and engage a striker to secure the housing to the latch plate when the bolt is in the lower position and the strikers are positioned within the latch loops.

DETAILED DESCRIPTION OF THE INVENTION

Figure 1:
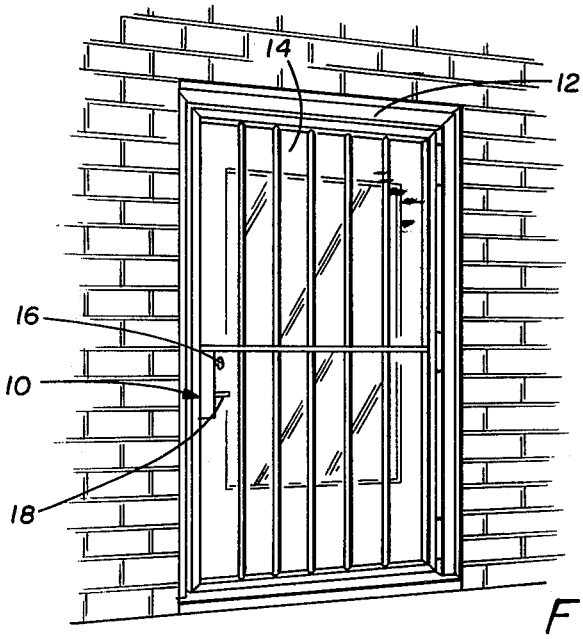
FIG. 1 is an illustration of a gate within a set of burglar bars having the drop latch of the present invention therein.

A drop latch designated generally as 10 is shown in FIG. 1 as it is installed in an ornamental gate 12. The gate and latch are included as a part of a set of burglar bars to prevent entry into the household being protected. Gate 12 is hinged to allow passage through the doorway 14 when the drop latch 10 is opened by use of a key 16. When drop latch 10 is unlocked by key 16, the latch is opened by depressing lever 18 which allows gate 12 to swing open. When gate 12 is closed, drop latch 10 automatically engages to close the gate. The latch is then locked closed by operation of key 16.

Figure 2:
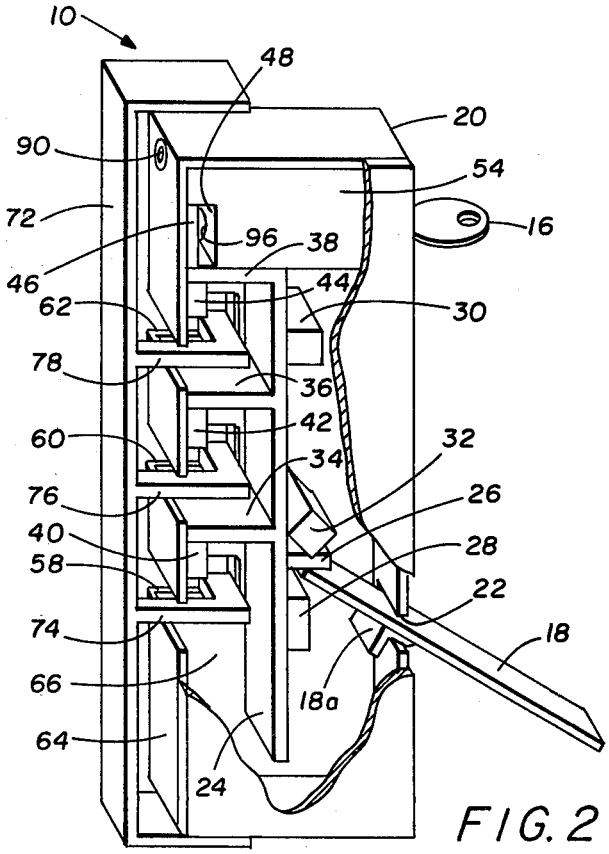
FIG. 2 is a perspective view of the drop latch of the present invention having the upper cover plate partially removed.

The drop latch 10 is illustrated in detail in FIG. 2. Latch 10 comprises a heavy metal housing 20 which encloses the working members of the latch. Lever 18 extends through a slot 22 in housing 20 and operates to pivot about the center of this slot. Lever 18 is provided with a bracket **18*a* mounted on the section of lever 18 within housing 20 to prevent lever 18 from being removed from housing 20. Lever 18 engages to operate a vertically aligned bolt 24 which is positioned vertically within housing 20. Bolt 24 was joined thereto blocks 26 and 28 which engage the end of lever 18 so that the lever can position bolt 24**.

Bolt 24 operates to move along a vertical path within housing 20, the bolt being guided by pins 30 and 32 which are mounted on an interior wall of housing 20. A group of three horizontal members 34, 36 and 38 are mounted transversely on bolt 24 and are contiguous the interior surfaces of housing 20. Bolt 24 is thus held in position horizontally between pins 30 and 32 and the group of horizontal members 34–38. Strikers 40, 42 and 44 are respectively connected to each of the horizontal members 34, 36 and 38. A vertical extension member 46 is joined to horizontal member 38 and extends into a slot 48. Extension member 46 enters slot 48 when bolt 24 is raised by depressing lever 18 and is lowered from slot 48 when pressure on lever 18 is released. Member 46 is retracted from slot 48 by gravity due to the weight of bolt 24 and the components attached thereto.

Drop latch 10 has included within housing 20 a lock cylinder holder 54 which is essentially a rectangular metal block. A jam screw 56 (see FIG. 4) is advanced into and returned from slot 48 by operation of key 16. When jam screw 56 is advanced into slot 48, extension member 46 and bolt 24 are locked in the lower position. But when jam screw 56 is withdrawn from slot 48, extension member 46 can enter into slot 48 and allow bolt 24 to rise.

Referring to FIG. 2 housing 20 is provided with a set of slots 58–62 which extend through walls 64 and 66 of housing 20. Slots 58–62 are positioned within housing 20 such that they are aligned with strikers 40–44 respectively when bolt 24 is in its lowermost position.

The drop latch 10 is designed to engage a latch plate 72 having latch loops 74, 76 and 78 joined as right angle sections thereto. Latch loops 74–78 are spaced and dimensioned so that they will enter into slots 58–62 respectively in housing 20. The latch loops are further dimensioned so that when they have entered into housing 20 the strikers 40–44 respectively can engage the loops thereby connecting latch 20 to latch plate 72.

Figure 3:
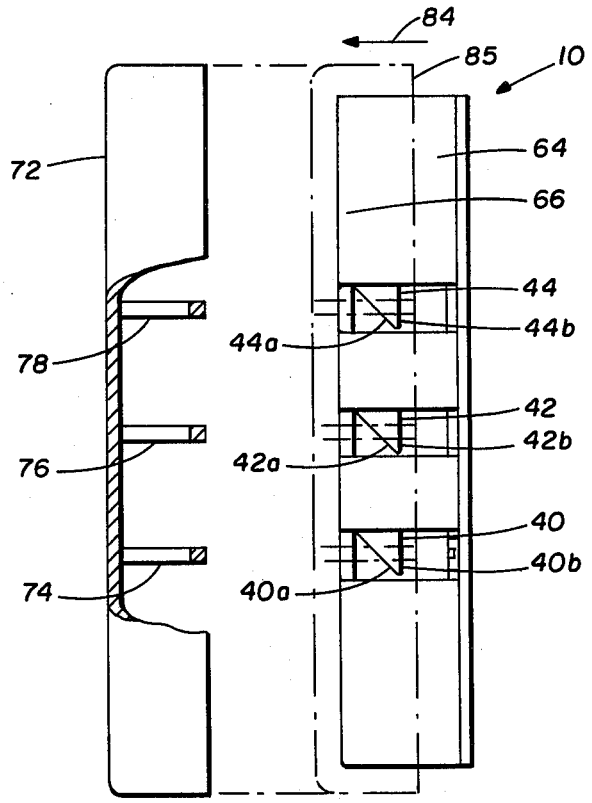
FIG. 3 is an elevation view of the end portions of the drop latch and latch plate of the present invention.

Drop latch 10 and latch plate 72 are illustrated in an elevation view in FIG. 3. Latch plate 72 is mounted rigidly on the frame of the doorway 14 so as to receive the drop latch 10 which is connected to gate 12. Drop latch 10 moves in the direction shown by arrow 84 to engage latch plate 72. As latch 10 moves in the direction of arrow 84 the latch loops 74–78 respectfully enter into slots 58–62 in housing 20. The latch plate is shown engaged to the latch in phantom lines 85. The latch loops do not strike the walls of the housing. As the latch loops 74–78 enter housing 20 they meet strikers 40–44 respectively which have tapered faces **40*a*–44*a* that contact the latch loops. As the strikers engage the latch loops the strikers are forced upward due to the tapering faces until the strikers are on top of the respective latch loops. The drop latch 10 is then advanced even further in the direction of arrow 84 until the strikers drop downward into the latch loops thus engaging drop latch 10 to latch plate 72. Latch 10 cannot be withdrawn from latch plate 72 as long as the strikers 40–44 are in the lower position because the strikers have flat surfaces 40*b*–44*b* on the side thereof engaging the respective latch loops. Drop latch 10 can be withdrawn from latch plate 72 only when the strikers are lifted upward to disengage from the latch loops 74–78**.

Figure 4:
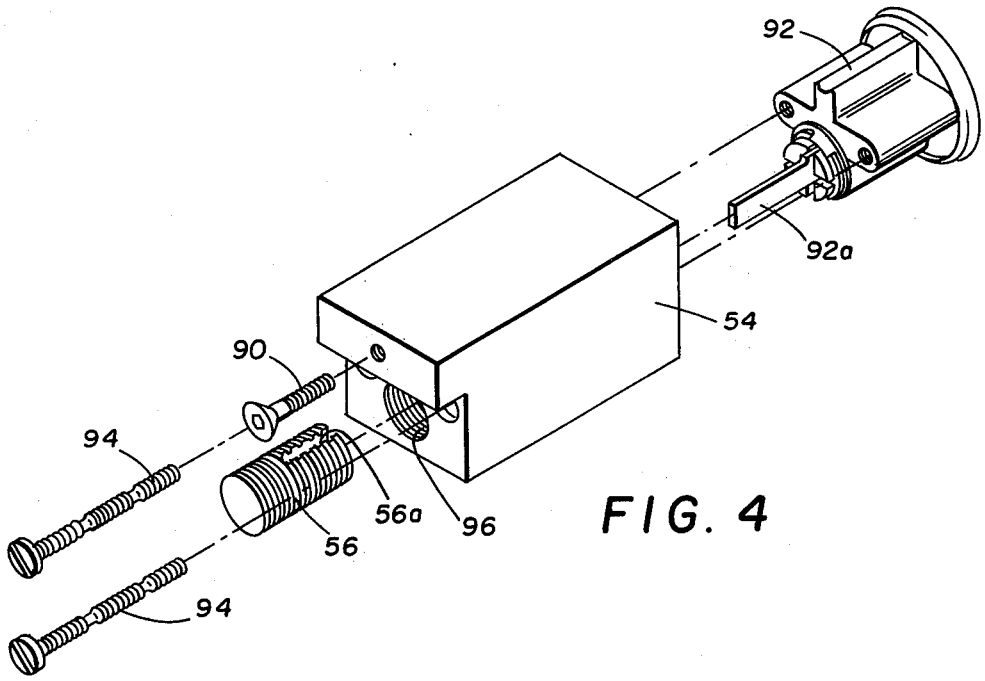
FIG. 4 is an exploded perspective view of the lock cylinder and adjacent components of the present invention.

Referring now to FIG. 4 there is shown the lock cylinder holder 54 and associated components in an exploded perspective view. Holder 54 is mounted in housing 20 and is secured thereto by a screw 90. A lock cylinder 92 is disposed within holder 54 and is connected thereto by bolts 94. Lock cylinder 92 has a tailpiece **92*a* which engages screw 56 in a slot 56*a* therein. Screw 56 engages a hole 96 in holder 54, hole 96 being threaded to receive the screw. Thus, as key 16 is advanced clockwise screw 56 is likewise advanced so as to enter into slot 48 and prevent member 46 from entering therein. This effectively jams bolt 24 and prevents the keepers from being released from the latch loops. In this configuration drop latch 10 is secured to latch plate 72 thereby preventing gate 12 from being opened. Gate 12 can be opened only when key 16 is rotated counterclockwise to retract screw 56 from slot 48. When this is done lever 18 can be depressed to raise bolt 24** and release the keepers from the latch loops.

The drop latch of the present invention further provides a reliable means for protecting the lock cylinder while permitting the lock cylinder to be easily removed and replaced. To change the lock cylinder 92 the drop latch 10 must be released from the latch plate 72 by operation of key 16. After the drop latch 10 is released the screw 90 is removed from engagement with holder 54 thus releasing the holder from housing 20. Bolts 94 are then removed to release key cylinder 92 from holder 54. A substitute lock cylinder 92 is then inserted in holder 54 wherein bolts 94 are reinserted into holder 54 to engage the new key cylinder. The holder 54 is then placed within housing 20 and screw 90 reinserted through housing 20 into holder 54 to secure the holder to the housing.

In summary, the present invention provides a drop latch which is gravity operated to engage a plurality of strikers with a plurality of latch loops to secure a gate to a doorway. The strikers are connected to a vertically disposed bolt which is operated by a lever extending through a housing. The bolt is fixed in a locked position by advancing a jam nut operated by a key.

Although an embodiment of the invention has been illustrated in the accompanying drawings and described in the foregoing detailed description, it will be understood that the invention is not limited to the embodiment disclosed, but is capable of numerous rearrangements, modifications and substitutions without departing from the scope of the invention.

I claim:

1. A drop latch assembly, comprising in combination:

a housing;

a vertical bolt located within said housing and guided for movement therein between first and second positions, said bolt normally being located in the first position;

a lever extending through a passage in said housing to engage said bolt, said lever being selectively operable to elevate said bolt to the second position;

at least one arm joined transversely to said bolt within said housing, said arm having a depending striker mounted normal thereto;

said housing having therein a slot corresponding to each striker, said slot being aligned with said striker when said bolt is in said first position;

key driven lock means including a horizontal jam unit disposed in said housing for horizontal movement into the path of said bolt to block said path for releasably locking said bolt in the first position;

a latch plate having a horizontal latch loop corresponding to each slot in said housing, said latch loop being adapted to enter said housing slot and engage said striker such that said latch plate and housing are lockingly interconnected; and the contacting surfaces of the striker of said bolt and the latch loop of said latch plate being configured such that said bolt is momentarily cammed out of the first position before the striker seats within the latch loop.

2. A drop latch assembly as recited in claim 1 wherein said bolt is mounted vertically within said housing to fall to said first position by action of gravity in the absence of a force applied to said lever.

3. A drop latch assembly as recited in claim 1 wherein said arm extends from said bolt and is contiguous at least one interior wall of said housing to guide said bolt along said path.

4. A drop latch assembly as recited in claim 1 wherein said latch plate comprises a right angle metal member and said latch loop comprising a metal member extending from one section of said latch plate across the right angle thereof to another section of said plate, wherein said latch loop has an opening therein for receiving one of said strikers.

5. A drop latch assembly as recited in claim 1 wherein said releasable locking means comprises a lock cylinder with a removable key for rotatably driving a screw which jams said bolt in the first position when actuated by said key, said lock cylinder being removably mounted in a holder which is releasably secured to said housing and which includes a hole therein to receive said screw.

6. A drop latch assembly as recited in claim 5 wherein said lock cylinder and said screw are mounted normal to said bolt.

7. A drop latch mounted on a movable gate for engaging a latch plate mounted on a door frame, the latch plate having a plurality of latch loops, comprising in combination:

a rigid housing having a plurality of slots therein facing said latch plate, said slots being spaced apart and dimensioned to receive said latch loops into said housing;

a bolt disposed within said housing and guided for movement along a substantially vertical path between first and second positions, said bolt normally being situated in the first position;

a lever extending through a passage in said housing, said lever being engaged with said bolt and operable by applying a force to the section of said lever external to said housing;

a plurality of arms extending outwardly from said bolt opposite said lever within said housing adjacent the slots, each arm having a vertically and downwardly extending striker for associated with one of the latch loops;

said strikers having downward tapered faces which contact said latch loops to force said bolt upward until said strikers pass over said latch loops and drop inside said latch loops to latch said housing to said latch plate; and means disposed in said housing for releasably locking said bolt in the first position, said locking means including a lock cylinder with a removable key for driving a stop which prevents said bolt from leaving the first position when actuated by the key;

said lever being operable to move said bolt upward to lift said strikers from within said latch loops to disengage said housing from said latch plate key driven lock means including a horizontal jam unit disposed in said housing for horizontal movement into the path of said bolt to block said path for releasably locking said bolt in the first position.

* * * * *